US011130034B2

(12) United States Patent
Engler et al.

(10) Patent No.: US 11,130,034 B2
(45) Date of Patent: Sep. 28, 2021

(54) SPORTS GAME WITH SLOT CLIP SYSTEM

(71) Applicant: P&P IMPORTS LLC, Santa Ana, CA (US)

(72) Inventors: Peter H Engler, Newport Beaach, CA (US); Peter L. Tanoury, Newport Beach, CA (US)

( * ) Notice: Subject to any disclaimer, the term of this patent is extended or adjusted under 35 U.S.C. 154(b) by 0 days.

(21) Appl. No.: 16/388,553

(22) Filed: Apr. 18, 2019

(65) Prior Publication Data

US 2020/0330841 A1 Oct. 22, 2020

(51) Int. Cl.
*A63B 67/00* (2006.01)
*A63B 63/00* (2006.01)

(52) U.S. Cl.
CPC ..... *A63B 67/002* (2013.01); *A63B 63/00* (2013.01)

(58) Field of Classification Search
CPC ..... A63B 2210/50; A63B 5/11; A63B 63/004; A63B 69/0097
USPC ..... 273/398–402, 395, 396; 473/476–478, 473/434, 435
See application file for complete search history.

(56) References Cited

U.S. PATENT DOCUMENTS 3,502,330 A * 3/1970 Cheftel ..... A63B 5/11 273/395
5,447,304 A * 9/1995 Vargas ..... A63B 63/083 473/489
5,476,266 A * 12/1995 Caruso ..... A63B 63/004 160/330
5,934,679 A * 8/1999 Strain ..... A63B 51/04 273/127 C
5,941,798 A * 8/1999 Coan ..... A63B 5/11 482/27
6,808,463 B1 * 10/2004 Stockwell, III ..... A63B 63/004 473/476
7,241,235 B2 * 7/2007 Caruso ..... A63B 63/004 273/400
7,300,059 B2 * 11/2007 Caruso ..... A63B 63/004 273/400
7,789,376 B2 * 9/2010 Diamond ..... E04H 17/161 256/54
8,807,568 B1 * 8/2014 Ruder ..... A63B 67/002 273/342

(Continued)

OTHER PUBLICATIONS

Slammo—GoSports Slammo Game Set (Includes 3 Balls, Chttps://www.amazon.com/GoSports-Slammo-Balls-Carrying-Rules/dp/B00K8ANYZU/ref=sr_1_2?keywords=slammo&qid=1555525513&s=gateway&sr=8-2arrying Case and Rules), Published at least as early as Apr. 17, 2019.

(Continued)

*Primary Examiner* — Jeffrey S Vanderveen
(74) *Attorney, Agent, or Firm* — Casey H. Kempner; Siamak S. Hefazi

(57) ABSTRACT

A roundnet game and components are provided. The roundnet includes a plurality of legs. Each of the plurality of legs contains a first leg socket and a second leg socket. The roundnet further includes a plurality of slotted tubing attached to the plurality of legs forming a perimeter of the roundnet. The roundnet further includes each of the slotted tubing with at least one slot. The roundnet further includes a plurality of track of clips. The roundnet further includes at least one track of clips attached to the at least one slot in each of the plurality of slotted tubing. The roundnet further includes a net forming a playing surface about the perimeter of the roundnet.

19 Claims, 16 Drawing Sheets

(56) References Cited

U.S. PATENT DOCUMENTS

| | | | | |
|---|---|---|---|---|
| 2003/0060309 | A1* | 3/2003 | Smith, IV | A63B 69/0002 473/431 |
| 2011/0059816 | A1* | 3/2011 | Campanaro | A63B 69/0097 473/435 |
| 2013/0023359 | A1* | 1/2013 | Goodman | A63B 69/0071 473/434 |
| 2019/0269993 | A1* | 9/2019 | Gonzales | A63B 71/023 |

OTHER PUBLICATIONS

Spikeball—3 Ball Kit—https://www.amazon.com/stores/node/6913073011?_encoding=UTF8&field-lbr_brands_browse-bin=Spikeball&ref_=bl_dp_s_web_6913073011, Published at least as early as Mar. 14, 2019.

Spikeball—Spikeball Pro Kit (Tournament Edition)—https://www.amazon.com/Spikeball-Pro-Kit-Tournament-Upgraded/dp/B01M0XJYVO?ref_=bl_dp_s_web_6913073011, Published at least as early as Apr. 17, 2019.

* cited by examiner

SPORTS GAME WITH SLOT CLIP SYSTEM

TECHNICAL FIELD

The present disclosure generally relates to sports games, and more particularly to a roundnet game with a slot clip system.

BACKGROUND

In recent years, a popular sports game referred to as "roundnet" has emerged. The players of roundnet bounce an object (e.g., a ball, etc.) off a roundnet playing surface (e.g., a taut net, fabric, material, etc.) so that it rebounds into the air for the next player to touch. The playing surface is held taut in part by certain components of the roundnet, such as clips, as described in more detail below. The playing surface is typically a net made from a natural or synthetic material, and is attached to the clips at the perimeter of the roundnet. To start game play (i.e., to initiate service), a ball is directed to the playing surface by a first player (e.g., by a player throwing the ball into the air and hitting it with their hand towards the playing surface). The service is complete when the ball impacts the playing surface and rebounds into the air. Once the ball rebounds off the playing surface, a second player then directs the ball back at the playing surface, or passes the ball to a teammate.

In certain aspects, roundnet uses rules similar to volleyball. For example, players first surround the roundnet (e.g., two or more players on each team). A player on the first team hits a ball at the playing surface of the roundnet, initiating a service. Then the second team has up to a certain number of alternating touches of the ball (e.g., three touches, etc.) to return the ball to the playing surface. If the second team successfully returns the ball to the playing surface, possession changes back to the first team, wherein the first team then has up to a certain number of touches of the ball to return the ball to the playing surface. Game play continues in this manner until one team fails to return the ball to the playing surface within the designated number of touches. The number of players and rules may be altered as desired for different game play, and even a single person may use the roundnet on their own.

The perimeter of a roundnet should be rigid enough to support the tension of a playing surface and the impacts from a ball during game play. In certain aspects, the perimeter is substantially level and supported by a number of supports (or legs). The legs should be tall enough to prevent the playing surface from reaching the ground below when impacted by the ball, but not so tall as to make it difficult to play (e.g., meters tall).

The overall tautness (or tension) of the playing surface is in part controlled by how tight the material (e.g., net, etc.) is stretched when it is attached about the perimeter of the roundnet (e.g., to clips). Typically, the higher the tension of the playing surface, the higher an object (e.g., a ball) will rebound therefrom. Tension may be adjusted to suit the preference of the players and the desired game play. A high tension is generally preferable.

Over the years, several iterations of roundnet games (or "roundnets") have emerged, some with different ways of attaching the playing surface to the roundnet perimeter. As will be discussed in more detail below, the currently available roundnet designs suffer from undesirable features. Thus, an improved roundnet is needed in the art.

SUMMARY

A roundnet game, components thereof, and methods of use and manufacturing are provided herein. The roundnet includes a plurality of legs. Each of the plurality of legs contains a first leg socket and a second leg socket. The roundnet further includes a plurality of slotted tubing attached to the plurality of legs forming a perimeter of the roundnet. The roundnet further includes each of the slotted tubing with at least one slot. The roundnet further includes a plurality of track of clips. The roundnet further includes at least one track of clips attached to the at least one slot in each of the plurality of slotted tubing. The roundnet further includes a net forming a playing surface about the perimeter of the roundnet.

DESCRIPTION OF THE DRAWINGS

The present disclosure is more readily apparent from the specific description accompanied by the following drawings, in which.

DETAILED DESCRIPTION

Those of ordinary skill in the art will appreciate that depending on the particular application at hand, many modifications, substitutions and variations can be made in, and to, the materials, apparatus, configurations, and methods of use of the devices of the present disclosure, and the innovations herein are not limited to any of the particular embodiments that are illustrated and described herein. The description below is merely an explanation by way of some examples thereof that should be fully commensurate with that of the claims appended hereafter and their functional equivalents, and merely serves to inform one of ordinary skill in the art how to make and use the innovations disclosed herein.

Figure 1A:
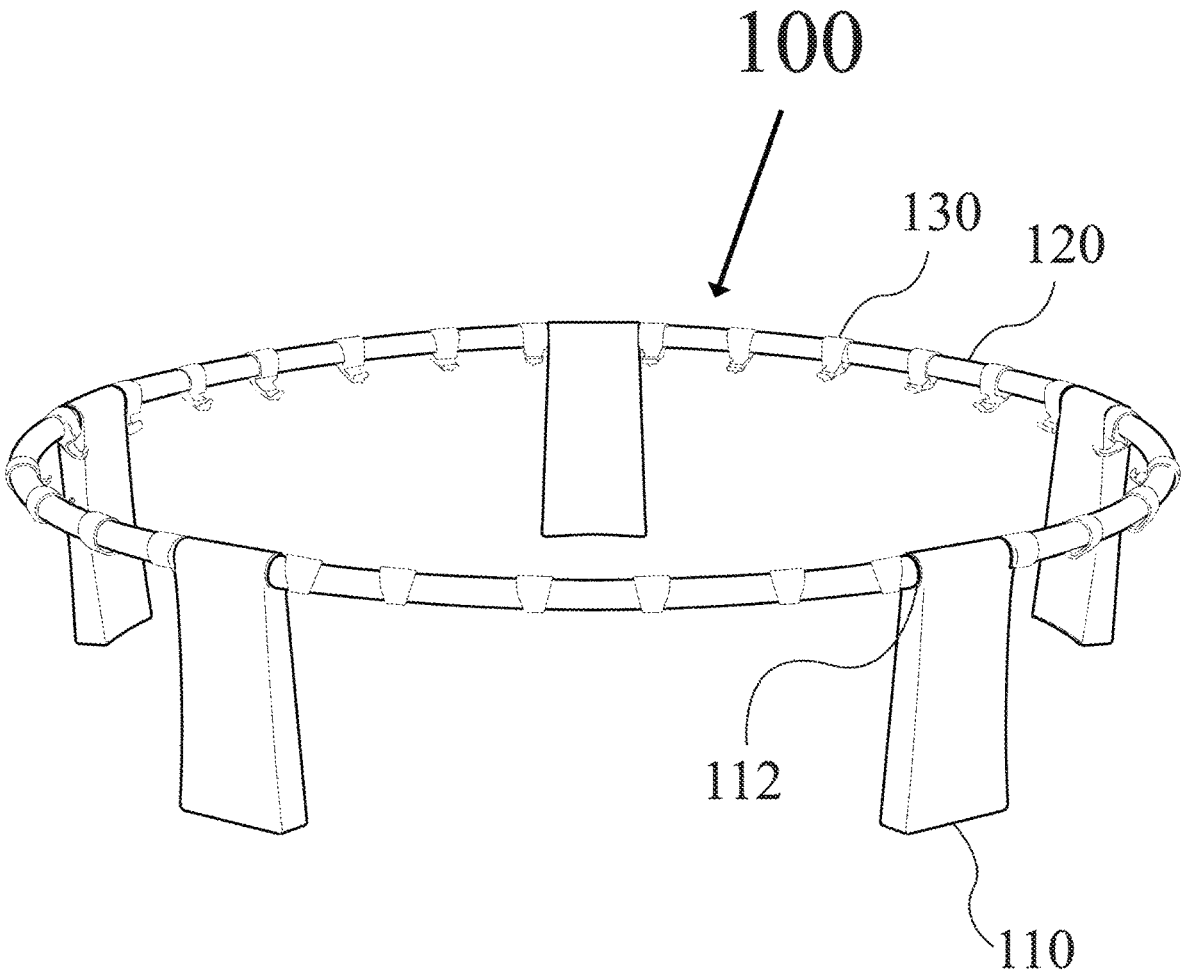
FIGS. 1A and 1B are illustrations of a roundnet game.

FIG. 1A shows roundnet 100 without a playing surface to aid in identification of certain components. Roundnet 100 includes five legs 110, five sections of tubing 120, wherein the plastic tubing has a circular cross-section, and a plurality of clips 130 attached to tubing 120 that have a circular inner cross-section of smaller diameter than the cross section of clips 130, such that clips 130 slide along and around tubing 120 as shown and described in more detail in FIG. 2.

The perimeter of roundnet 100 (i.e., the portion of roundnet 100 that is substantially formed by the assembled five sections of tubing 120 and the five legs 110 when connected together) (e.g., by inserting a first end of tubing 120 into a first leg socket of a first leg 110 (e.g., leg socket 112), and by inserting a second end of the first section of tubing 120 into a second leg socket of a second leg, and continuing in similar method until all ends of the five sections of tubing 120 are inserted into the ten leg sockets 112 of the five legs, as shown assembled in FIG. 1). Further, the depth of each section of tubing 120 inserted into a leg 110 may vary, but generally a section of tubing 120 is inserted into a leg 110 to a depth that allows sufficient strength to assemble and use roundnet 100 in game play.

It will be appreciated that each clip 130 in FIG. 1 is attached to each section of tubing 120 before the section of tubing 120 is connected to both the first leg 110 and the second leg 110. The number of clips 130 on each section of tubing 120 may be user selected (e.g., generally about four to eight clips). It will be appreciated that roundnet 100 shows about the same number of clips 130 attached to each section of tubing 120 (e.g., about five to six clips 130 on each section of plastic tubing 120, for a total of about 30 clips 130) and clips 130 are also shown generally spaced evenly around the perimeter of roundnet 100. It will be appreciated that in roundnet 100, each clip 130 is spaced by a user. It will be further appreciated that clips 130 may move (e.g., during game play, transport, etc.).

Figure 1B:
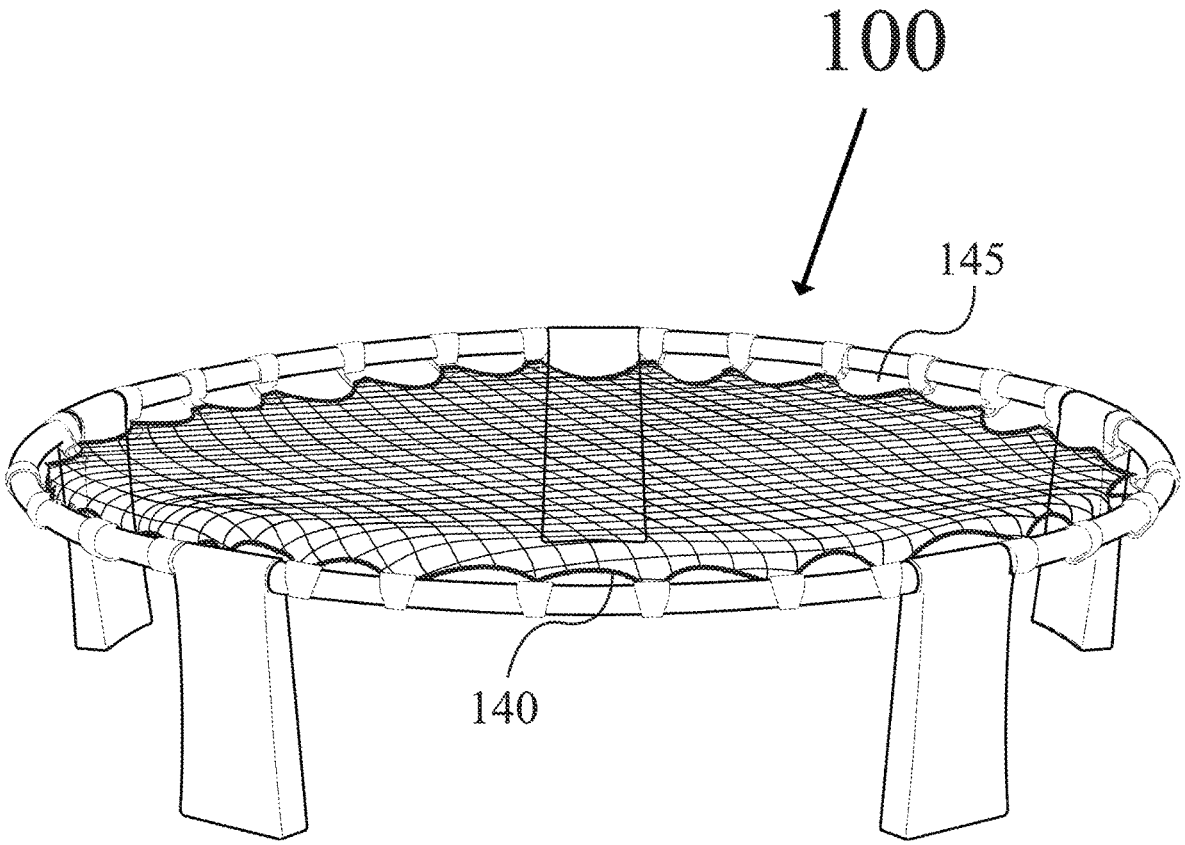

FIG. 1B shows roundnet 100 from FIG. 1 with net 140 attached to clips 130, thereby forming a playing surface. The net 140 is attached to each clip 130 by friction, and the net 140 is stretched reasonably taut (e.g., by a user during assembly). As shown in FIG. 1B, the playing surface of roundnet 100 in FIG. 1B is generally inside the roundnet perimeter.

A disadvantage of roundnet 100 is that clips 130 are free to rotate radially (around) and longitudinally (along) the sections of plastic tubing 120. As shown in FIG. 1B, when net 140 is attached to clips 130, clips 130 are pulled inward towards the center of the perimeter as a result of the tension induced in net 140. It will be appreciated that the size of the playing surface of roundnet 100 is generally less than the area inside the perimeter, as a result of gaps 145 forming between the net 140 and the perimeter of roundnet 100 when there is tension in net 140 (e.g., when assembled for game play).

It will be further appreciated that clips 130 can be installed in the wrong direction (e.g., with the clip curving inversely to that shown when pulled by net 140 inward). Incorrect assembly can cause problems with game play, and/or require time to disassemble and reassemble roundnet 100.

Figure 2:
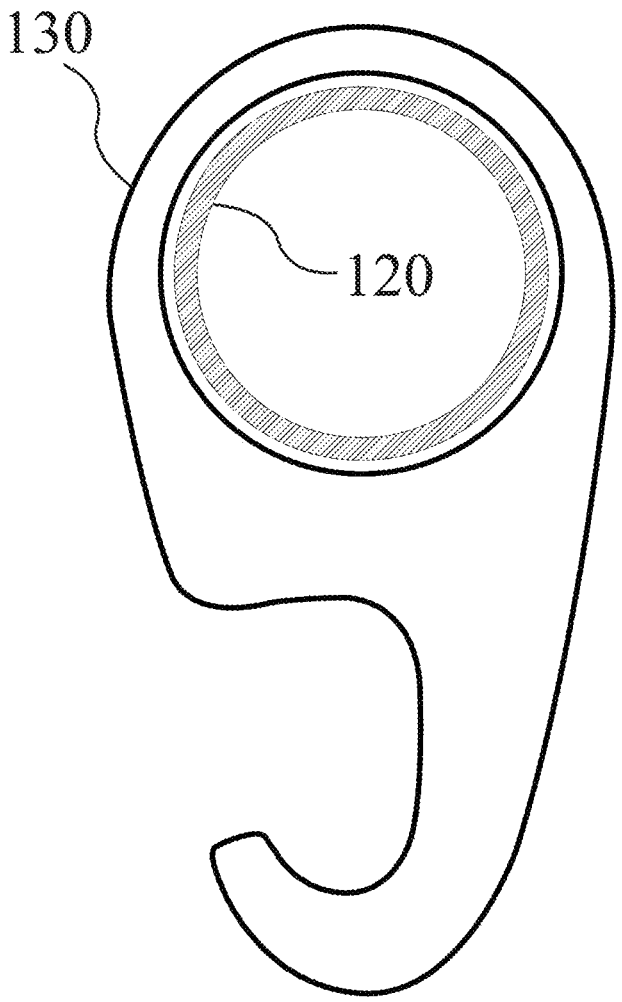
FIG. 2 is an illustration of certain components of a roundnet game.

FIG. 2 shows a cross section of certain components of roundnet 100 in FIGS. 1A and 1B, namely a cross section of clip 130 attached to tubing. It will be appreciated that as shown in FIG. 2, clip 130 may rotate freely around and along tubing 120.

Figure 3A:
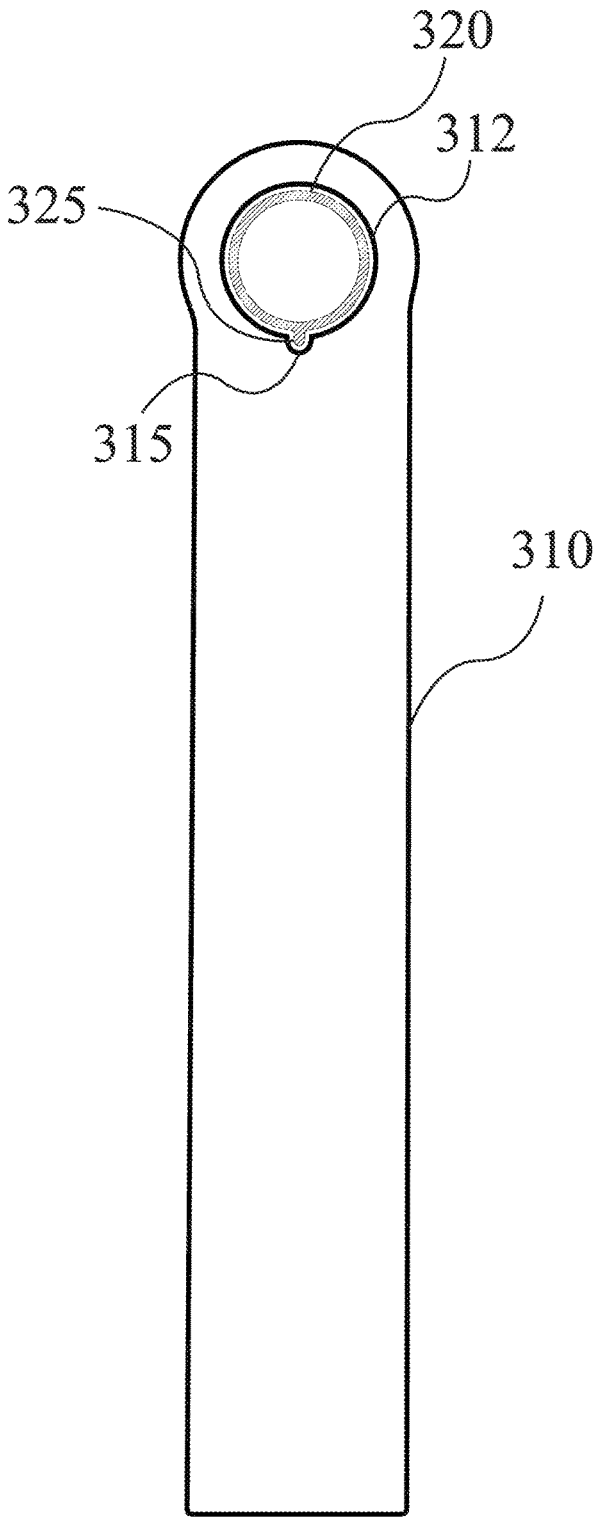
FIGS. 3A and 3B are illustrations of certain components of a roundnet game.
Figure 3B:
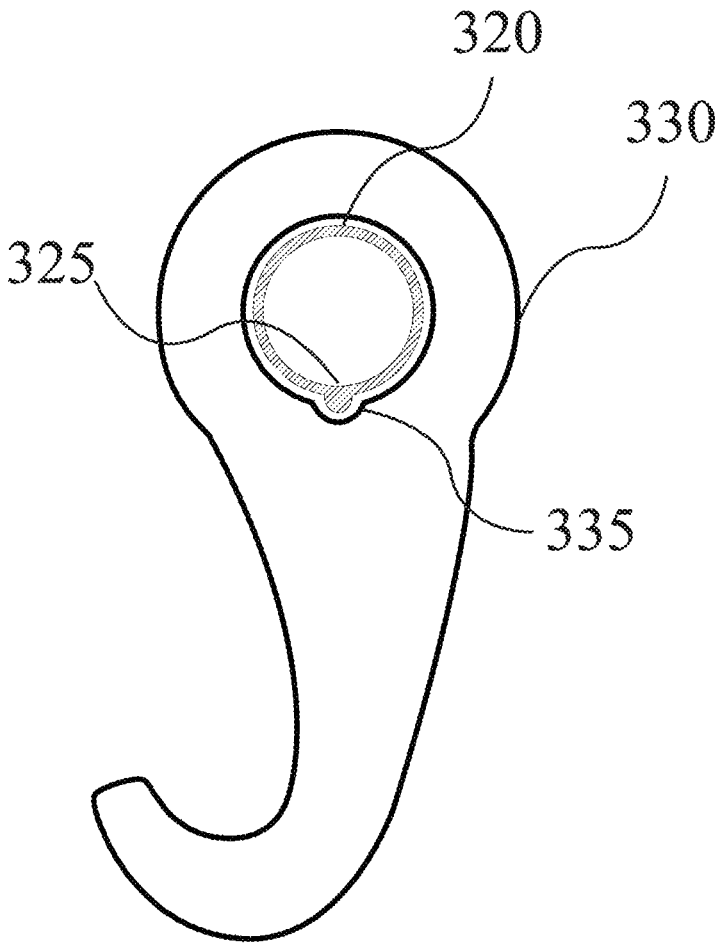

An improvement in the roundnet field emerged as shown in FIGS. 3A and 3B. FIG. 3A shows a side view of leg 310 that includes leg socket 312 for receiving a section of tubing 320 (shown as a cross section). Leg 310 has a notch 315 (or lock) as shown. Tubing 320 has a complementary key 325 (i.e., a protrusion extending radially from the surface of tubing 320 that fits into notch 315 when tubing 320 is inserted into leg socket 312).

FIG. 3B shows a cross section of a clip 330 with a notch 335. As noted above in FIG. 3A, tubing 320 has a key 325 that engages notch 335 of clip 330 when clip 330 is attached to tubing 320 (e.g., by sliding tubing 320 through clip 330).

Figure 4:
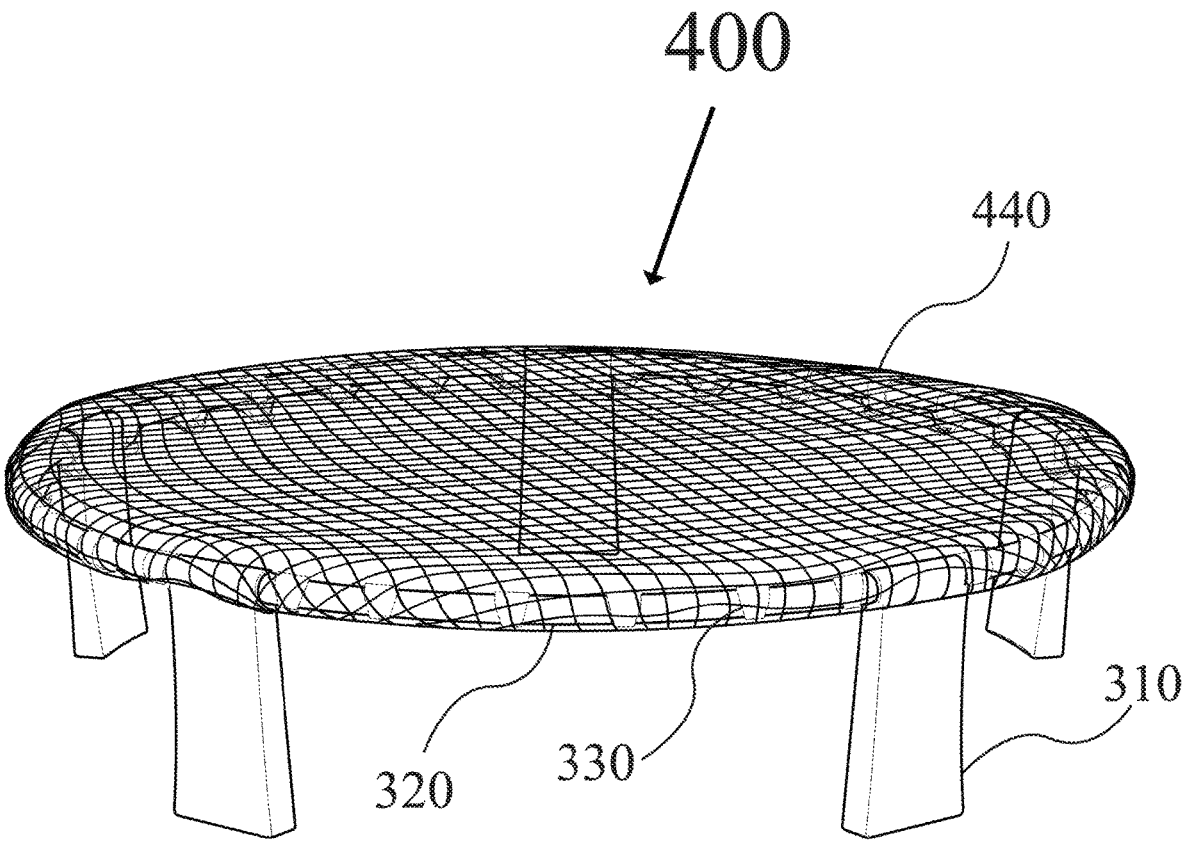
FIG. 4 is an illustration of a roundnet game.

FIG. 4 shows roundnet 400 that uses in part the roundnet components shown in FIGS. 3A and 3B (e.g., legs 310, tubing 320, and clips 330). It will be appreciated that clips 330 of roundnet 400 do not rotate around tubing 320 when roundnet 400 is assembled with net 440 because clips 330 and tubing 320 use the notch and key design shown in FIGS. 3A and 3B. It will be appreciated that net 440 wraps over the perimeter of roundnet 400 and attaches to clips 330 without clips 330 rotating inward towards the direction of the tension in net 440 as they are restrained in part by the notch and key design. Roundnet 400 allows a larger playing surface about the perimeter of that does not have pockets between the net 440 and the perimeter of roundnet 400 (compare to pockets 145 shown in FIG. 1B). It will be appreciated that clips 330 are only keyed radially as shown in FIGS. 3A and 3B, and thus are free to slide along the perimeter (along plastic tubing 320). Moreover, the spacing between clips 330 is variable based on how a user assembles roundnet 400 (e.g., placing some clips 330 close together, and other clips 330 far apart).

In certain aspects, having even spacing between clips on a roundnet is preferred, as even spacing can allow more uniform attachment of the net, and thus a more consistent playing surface during game play (e.g., by providing a more uniform rebound across the playing surface, etc.). In certain cases, a section of tubing 320 may be installed with more clips 330 than another section of tubing 320 (e.g., as a result of miscounting, careless assembly, etc.). For example, a user may use four clips 330 on a first section of tubing 320 and seven clips 330 on a second section of tubing 320. Thus, it will be appreciated that while roundnet 400 in FIG. 4 is less likely to have gaps between the perimeter of roundnet 400 and the playing surface compared to roundnet 100 in FIG. 1B; however, roundnet 400 may still suffer from inconsistent game play, incorrect assembly, and other drawbacks.

Figure 5:
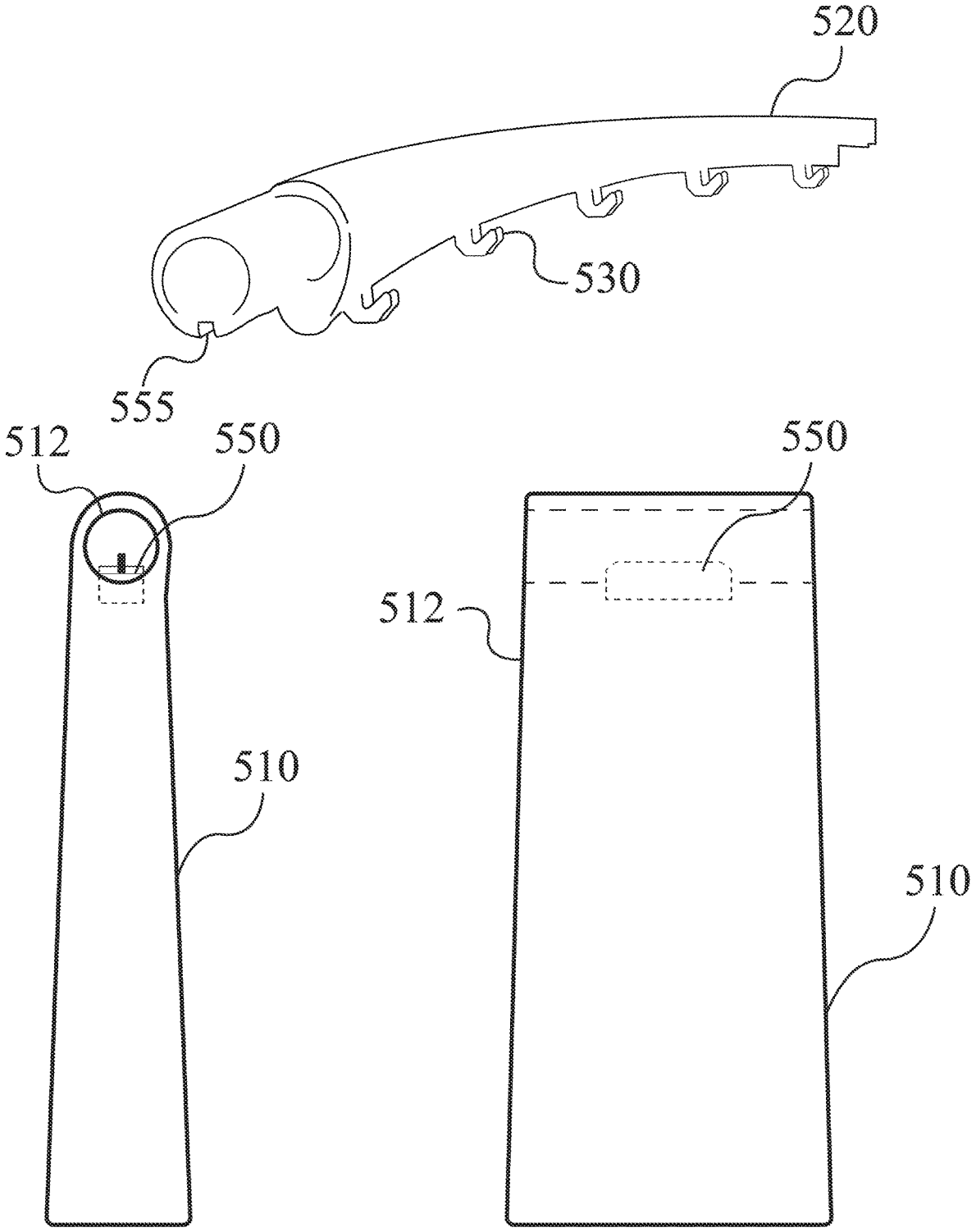
FIG. 5 is illustrations of certain components of a roundnet game.

FIG. 5 shows components of a roundnet including legs 510 and tubing 520 with integrated clips 530. It will be appreciated that while clips 530 are molded as part of tubing 520. Molding clips 530 as part of tubing 530 solves the problem of not having clips spaced evenly around the perimeter of the roundnet, but it introduces several other drawbacks. In certain aspects, tubing 520 includes a complex notched end 555 to fix the location of leg 510 in leg socket 512. It will be appreciated that leg socket 512 is circular. Leg 510 also includes a sprung receiver 550 as shown in FIG. 5. Receiver 550 and notch 555 engage to fix the position of leg 510 and tubing 520 when the receiver 550 is extended into notch 555, and leg 510 is free to rotate around tubing 520 when receiver 550 is not extended (e.g., by turning tubing 520 to depress receiver 550). It will be appreciated that the portion of plastic tubing that is inserted into leg socket 512 of leg 510 has a substantially circular cross section allowing leg 510 to rotate around tubing 520. Tubing 520 with integrated clips 530 is formed by injection molding.

It will be appreciated that if a clip 530 breaks off tubing 520, the entire section of tubing 520 and clips 530 generally requires replacement as the clips are not replaceable without replacing tubing 520. Additionally, wear in receiver 550 can allow leg 510 to rotate, which may be detrimental to optimal game play.

Figure 6A:
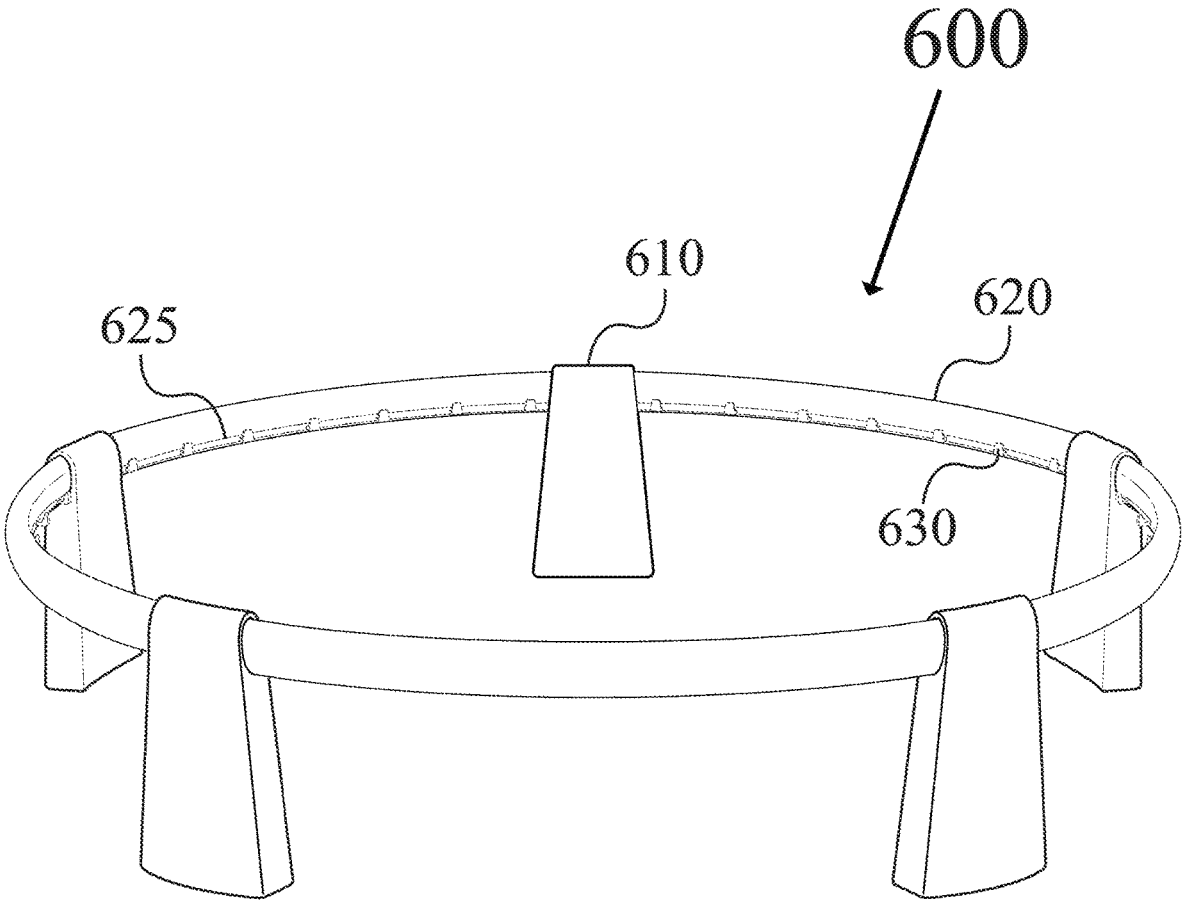
FIGS. 6A and 6B are illustrations of a roundnet game in accordance with certain aspects of the present disclosure.

FIG. 6A shows a roundnet with a slot clip system in accordance with certain aspects of the present disclosure. FIG. 6A shows roundnet 600 including five legs 610, five sections of tubing 620, wherein each section of tubing includes a slot 625, and five tracks of clips 630.

Legs 610 may generally be a number of shapes and sizes (e.g., user selected designs, etc.) without deviating from the disclosure. In certain aspects, legs 610 are several centimeters tall (e.g., 10 cm to 30 cm), but may be shorter or taller. The width and/or depth of legs 610 may also be narrow (e.g., a few centimeters) or wide, (e.g., tens of centimeters).

Legs 610 may be made from a number of materials. For example, legs 610 may be formed from one of the various plastics or composites known in the art (e.g., nylon, polyethylene (e.g., PTE, HDPE, LDPE, etc.), polyvinyl chloride, polypropylene, polycarbonate, acrylonitrile butadiene styrene, polylactic acid, acrylic, etc.), or they may be formed from non-plastics (e.g., wood, carbon, metal, etc.) or a composite thereof.

Tubing 620 may be made from a number of materials. For example, tubing 620 may be formed from one of the various plastics or composites known in the art, or they may be formed from non-plastics or a composite thereof.

The track of clips 630 may be made from a number of materials. For example, the track of clips 630 may be formed from one of the various plastics or composites known in the art, or they may be formed from non-plastics, or a composite thereof.

In certain aspects, legs 610, tubing 620, and track of clips 630 are made from ABS. In other aspects, legs 610, tubing 620, and track of clips 630 are made from PVC. In yet other aspects, legs 610, tubing 620, and track of clips 630 are made from polypropylene. In certain aspects, one or more of legs 610, tubing 620, and/or track of clips 630 are formed from the same material. In other aspects, legs 610, tubing 620 and track of clips 630 are made from one or more different materials.

In certain aspects legs 610, tubing 620, and track of clips 630 are made by extrusion molding, but in other aspects, one or more of legs 610, tubing 620, and track of clips 630 are made using other techniques known in the art (e.g., injection molding, 3-dimensional printing, machining, a combination thereof, etc.). It will be appreciated that in certain aspects, components of roundnet 600 may be fabricated more cost effectively than other roundnet tubing (e.g., tubing 520 in FIG. 5).

As shown in FIG. 6A, each tubing 620 includes a slot 625 that receives a track of clips 630. Slot 625 provides a number of advantages over other roundnets (e.g., the roundnets shown in FIGS. 1-5, etc.). For example, tubing 620 and track of clips 630 may be formed from different materials (e.g., one of the may plastics, non-plastics, or composites described above), thus a manufacturer can tailor certain properties (e.g., flexibly of each component, fabrication techniques, color, etc.) or create cost effective replacement parts. In certain aspects, the color of one or more sections of tubing 620, legs 610, and track of clips 630 in roundnet 600 are different; however, in other aspects, one or more components in roundnet 600 are the same color. In certain aspects tubing 620 and track of clips 630 are made from a black plastic.

As shown in FIG. 6A, track of clips 630 is configured to attach to (e.g., slide into) slot 625 of tubing 620. In certain aspects, one section of track of clips 630 is used for each section of tubing 620, wherein each section of track of clips 630 comprises a plurality of individual clips thereon 9 (e.g., 6, 7, etc.).

FIG. 6A shows five legs 610, five sections of track of clips 630 wherein each section of track of clips 630 contain 7 clips (attachment points), wherein the five sections of tubing 620 are shown in assembled form (without a playing surface or ball).

Figure 6B:
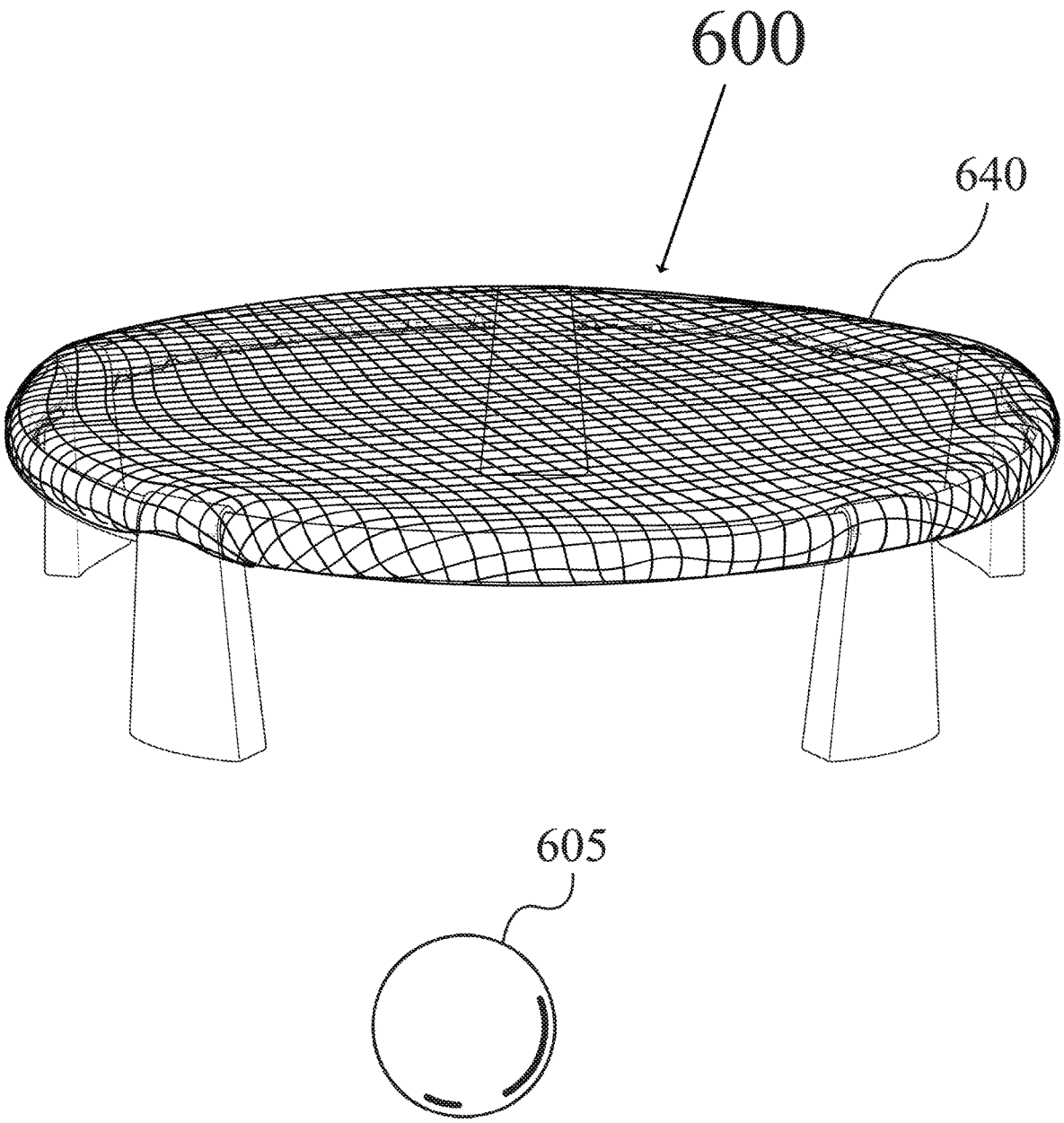

FIG. 6B shows roundnet 600 from FIG. 6A with net 640 attached about the perimeter to clips 630 to form a playing surface. FIG. 6B further shows a ball 605 that may be used for game play. While FIGS. 6A and 6B show a roundnet of 5 legs 610, five sections of tubing 620, and five sections of track of clips 630, other configurations may be used without deviating from the scope of the disclosure. For example, by adding an additional leg 610, tubing 620, track of clips 630, and a larger net, one may increase the size of roundnet 600 to form a larger roundnet, which may be preferable to the consumer. In certain aspects, a larger roundnet may be easier to play (e.g., by increasing the size of the playing surface, etc.). Thus, it will be appreciated that the number of legs 610, tubing 620, and track of clips 630, may be configured by the user.

In certain aspects, legs 610, tubing 620, and track of clips 630 are designed with a certain curvature (e.g., the curvature created by a 4 element, 5 element, 6 element, or 7 element roundnet, wherein the number of elements represents one leg, one tubing, and one track of clips). In other aspects, it will be appreciated that legs 610, tubing 620, and track of clips 630 can use the same curvature for more than a certain number of elements (e.g., the curvature used for a 5 element round net also works for a 6 element, or 7 element roundnet (e.g., because of the flexibility of materials, etc.)). Thus it will be appreciated that roundnet are commonly substantially circular, but a circle is not required. Moreover, the curvature of the legs 610, tubing 620, and track of clips 630 may be of similar, but not identical curvature without deviating from the scope of the disclosure.

In certain aspects, other geometric shapes may be used to form a roundnet within the scope of this disclosure (e.g., triangular perimeter, square perimeter, pentagonal perimeter, hexagonal perimeter, heptagonal perimeter, octagonal perimeter, or another polygonal shaped perimeter). In such cases, the angular portions may be the result of each respective leg design, each respective tubing design, or a combination of one or more legs and/or tubing design. For example, in a hexagonal roundnet, the tubing may be straight, and each leg may have a 60-degree bend between each leg socket. In another example, in a hexagonal roundnet, each tubing section may contain a 60-degree bend, and each leg may be straight (i.e., 180 degrees between each leg socket). Other configurations are similarly contemplated herein.

Figure 7A:
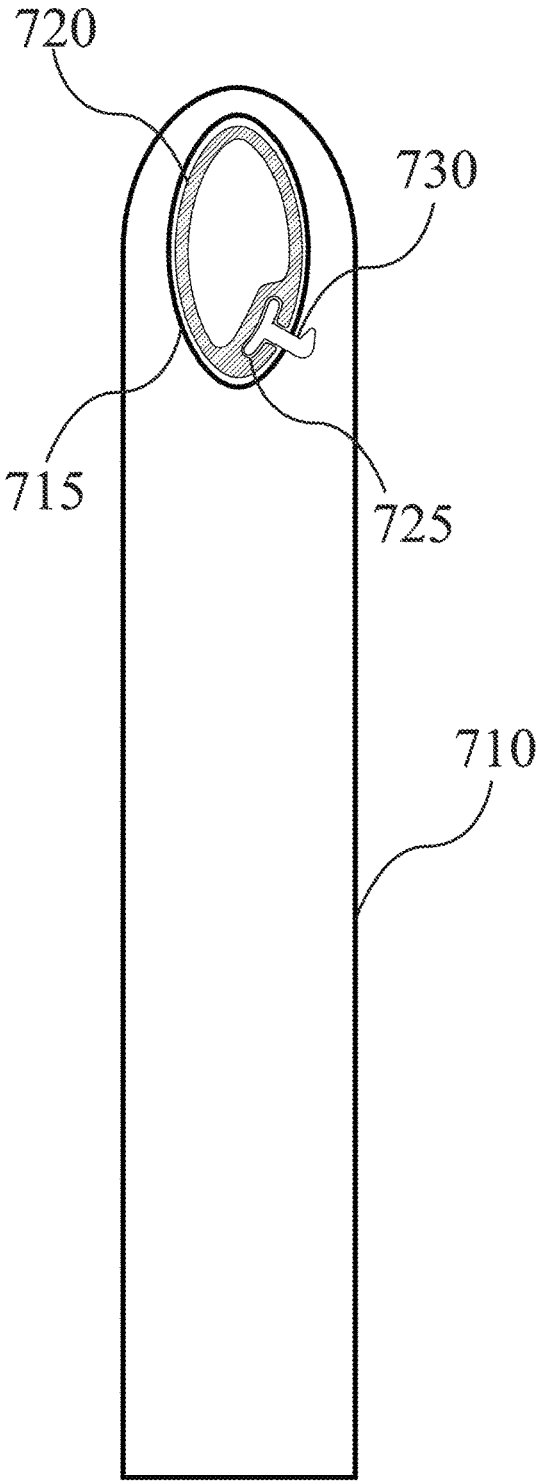
FIGS. 7A, 7B, and 7C are illustrations of certain components of a roundnet game in accordance with certain aspects of the present disclosure.

FIG. 7A shows a side view of a roundnet leg 710 that may be used with a roundnet in accordance with the present disclosure (e.g., roundnet 600 in FIGS. 6A and 6B). Leg 710 includes a leg socket 715 for receiving tubing 720 (e.g., tubing 720 is inserted leg 710 (in leg socket 715) and held in place by friction).

Leg socket 715 provides several advantages. As a non-limiting example, because leg socket 715 does not have a substantially circular cross section (e.g., leg socket 715 is shown as oval, etc.), and tubing 720 does not have a substantially circular cross (e.g., tubing 720 is oval, etc.), the orientation between leg 710 and tubing 720 are fixed in place by way of geometry (e.g., which is shown as keeping leg 710 substantially perpendicular to the playing surface of the roundnet when assembled without the use of a protrusion therefrom (i.e., a notch and key (e.g., as shown in FIGS. 3A, 3B, 4 and 5)). Thus, it will be appreciated that tubing 720 is prevented from rotating inside leg 710 because it uses a non-circular cross section. In certain aspects, leg socket 715 and tubing 720 have an asymmetric non-circular cross section design (not shown)(e.g., a leg socket having a larger radius on the top end of the leg socket 715 and a smaller radius on the bottom end of the leg socket 715). In certain aspects, other non-circular shapes may be used for tubing 720 and leg socket 715 (e.g., oval, triangular, polygonal, etc.) which can be selected based on user selected criteria (e.g., the desired number of fixed orientations that tubing 720 may be inserted into leg socket 715 of leg 710). In other aspects, a circular cross-section may be used for tubing 720 and leg socket 715.

Figure 7B:
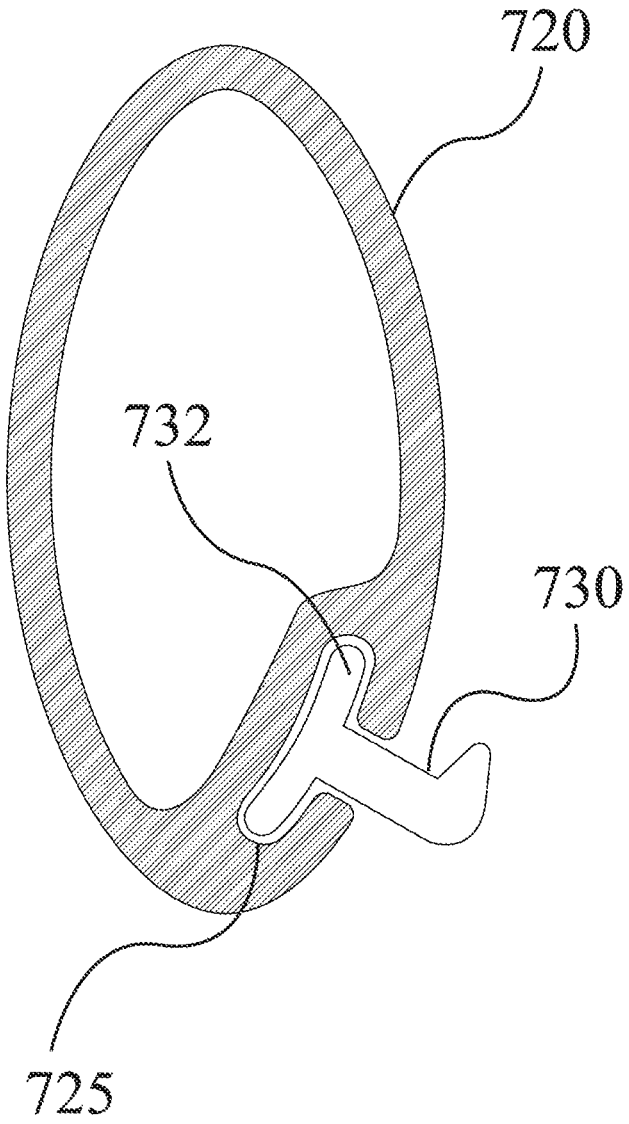
Figure 7C:
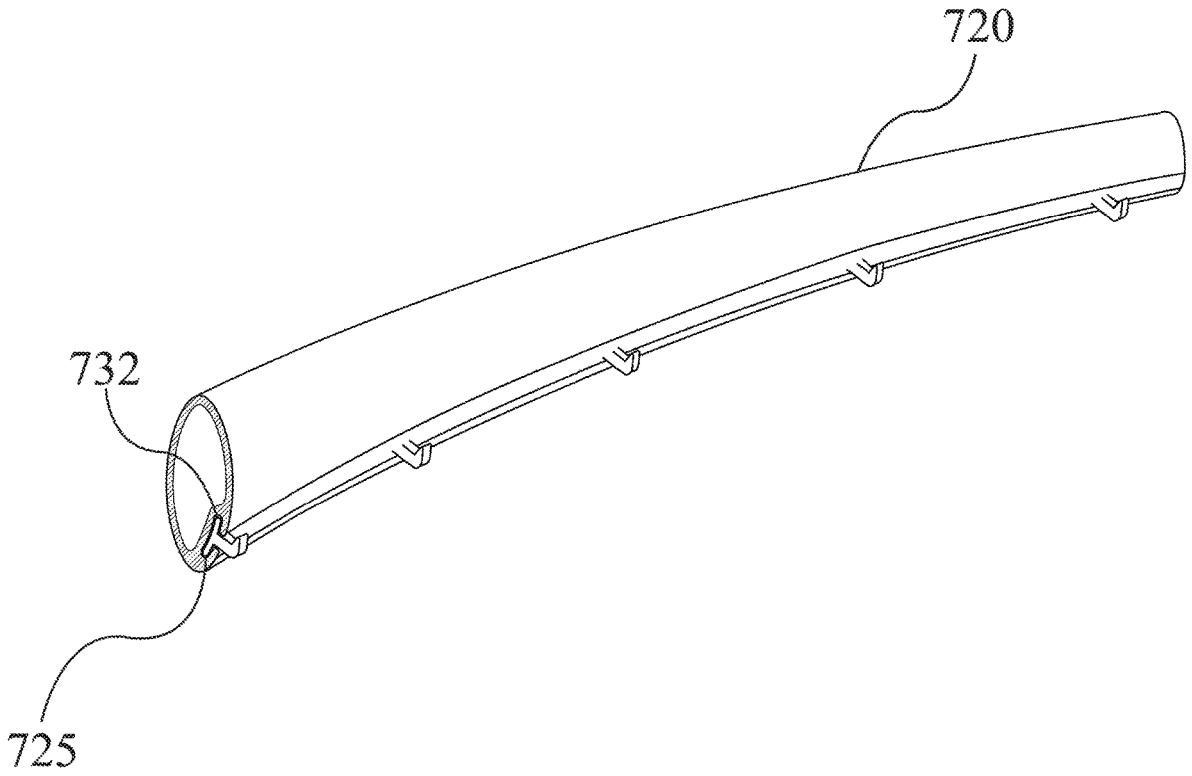

FIG. 7B shows a cross section of tubing 720 from FIG. 7A. FIG. 7B further shows a cross section of slot 725 and a cross section of track of clips 730. As shown, slot 725 is a slot (or recess) in tubing 720. As shown, a portion of the track of clips 730 is retained by slot 725 through friction. In certain aspects, a portion of the track of clips 730 is inserted into the end of tubing 720 (e.g., tab 732 of track of clips 730 is shown inserted into slot 725). In certain aspects, track of clips 730 is positioned so the end of track of clips 730 and tubing 720 are substantially aligned, as shown in FIG. 7C. It will be appreciated that when tubing 720 from FIG. 7C is inserted into a first leg socket and a second leg socket, that the track of clips 730 will remain substantially fixed in place (e.g., pressed against the inside of a leg (e.g., leg 610 in FIG. 6A) when inserted into a leg socket with little free play). FIG. 7C shows a single tubing 720 and a single track of clips 730, wherein tubing 720 and track of clips 730 are substantially aligned.

While one slot design is shown in FIGS. 6-7, other slot designs may be used without deviating from the scope of the disclosure. For example, in certain aspects, multiple slots are included in the tubing (not shown). It will be appreciated that multiple slots may be used, for example, to change the placement of a track of clips, for having multiple sets of tracks of clips on one roundnet, for color selection, etc.

In certain aspects, the slot (e.g., slots 625 and 725 shown in FIGS. 6-7) and the tab of the track of clips (e.g., tab 732 in FIGS. 7B and 7C) may be of an asymmetric design (not shown). It will be appreciated in certain aspects the tab on a track of clips may have an asymmetric design so that the track of clips may only be inserted in one direction based in part on the geometry of the tab and slot.

Figure 8A:
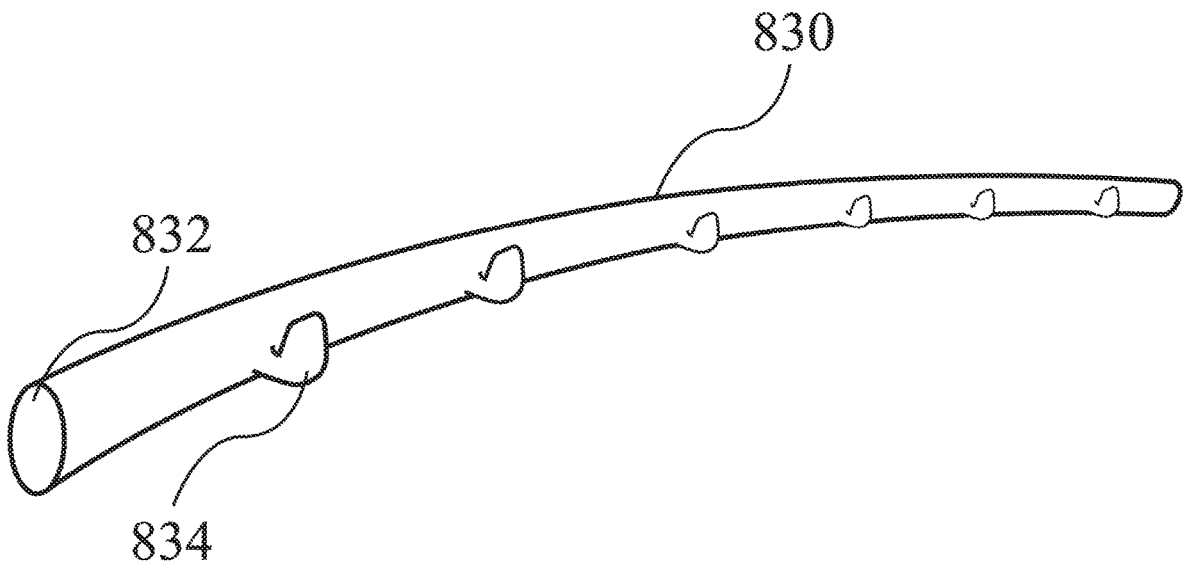
FIGS. 8A, 8B, 8C, and 8D are illustrations of certain components of a roundnet game in accordance with certain aspects of the present disclosure.

FIG. 8A shows a track of clips 830 that may be used with a roundnet in accordance with the present disclosure. Track of clips 830 is shown with an oval cross section tab 832 and 6 integrated clips (or attachment points) 834 for use with an oval cross section slot (not shown).

Figure 8B:
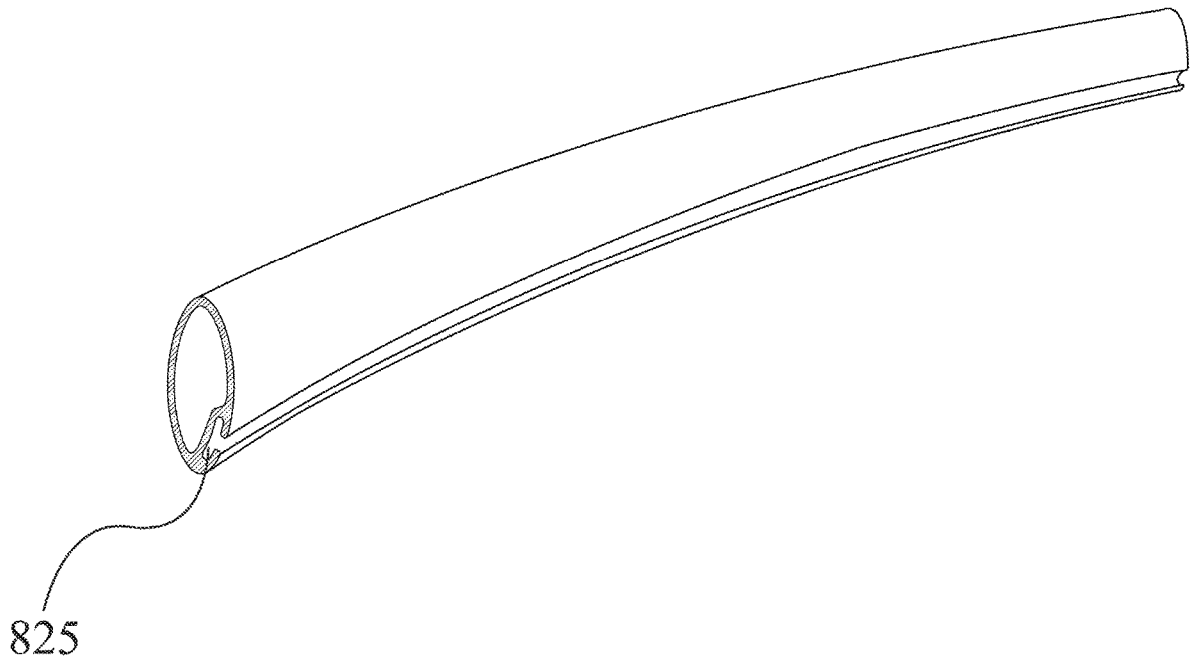

FIG. 8B shows a section of tubing 820 without a track of clips installed for use in a roundnet in accordance with the present disclosure. Tubing 820 includes slot 825.

Figure 8C:
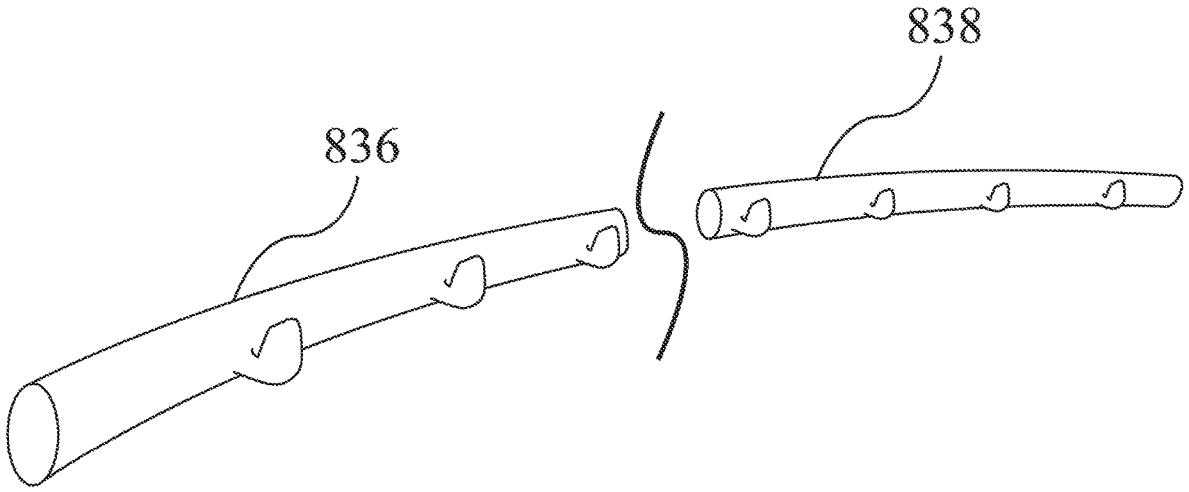

In certain aspects, a track of clips is molded as a single piece (e.g., as shown in FIGS. 6A-6B and FIGS. 7A-7C, etc.). In other aspects, a track of clips is formed in two or more pieces (as shown in FIG. 8C) showing a track of clips comprising track of clips sections 836 and 838. In certain aspects, more than one track of clips may be inserted into a slot in a section of tubing (e.g., slot 825 of tubing 820 in FIG. 8B.

Figure 8D:
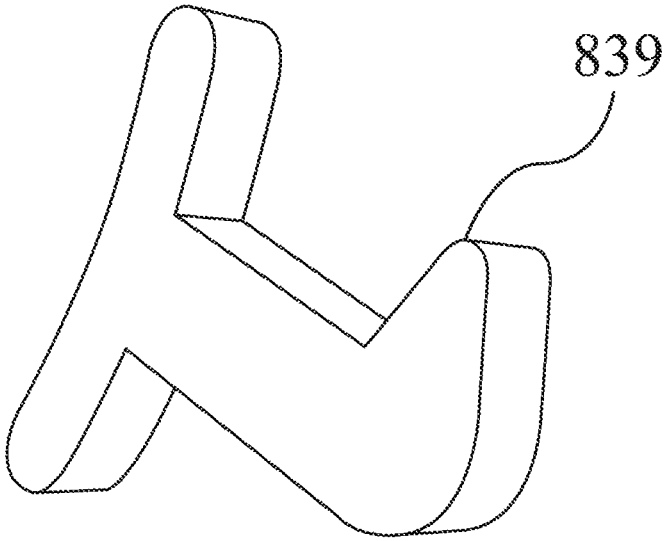

In certain aspects, when a track of clips is formed in two or more pieces, uniform spacings between individual clips are retained. For example, FIG. 8C shows track of clips sections 836 and 838, wherein track of clips sections 836 and 838 together are the same length as clips 830 in FIG. 8A, and the spacing between the attachment points remain substantially the same. In yet other aspects, a track of clips may refer to a single clip, such as clip 839 in FIG. 8D, or a plurality of single clips 839 (e.g., five to seven single clips 839 for each section of tubing), and or spacers.

In certain aspects, the reference to the singular form of a word may also refer to the plural, and a reference to the plural form of a word may refer to the singular thereof. While some of the advantages of the roundnet disclosed herein are provided, the advantages are not limited to those described herein, as one of ordinary skill in the art will appreciate more advantages and embodiments than those explicated listed or described herein.

What is claimed is:

1. A roundnet, comprising:

a plurality of legs; wherein each of the plurality of legs contains a first leg socket and a second leg socket;

a plurality of slotted tubing attached to the plurality of legs forming a perimeter of the roundnet, at least one of the plurality of slotted tubing comprising a slot configured to receive a track of clips, the track of clips extending an entire length of the slot;

the track of clips having a unitary structure comprising hooked clips fixedly spaced apart along a length of the track of clips, the track of clips being configured to insert into the slot and extend along a length of at least one of the plurality of slotted tubing; and a net, wherein the net is attachable to a plurality of the track of clips to form a playing surface within the perimeter of the roundnet.

2. The roundnet of claim 1, further comprising a ball.

3. The roundnet of claim 1, wherein the plurality of legs comprises five legs, the plurality of slotted tubing comprises five slotted tubing, and the plurality of track of clips comprises five tracks of clips.

4. The roundnet of claim 1, wherein the plurality of legs comprises six legs, the plurality of slotted tubing comprises six slotted tubing, and the plurality of track of clips comprises six tracks of clips.

5. The roundnet of claim 1, wherein each of the plurality of legs contains a first leg socket and the second leg socket having an oval cross section to fixedly attach at least one of the plurality of slotted tubing.

6. The roundnet of claim 1, wherein each of the plurality of legs contains a first leg socket and the second leg socket having a polygonal cross section to fixedly attach at least one of the plurality of slotted tubing having a complimentary shape.

7. The roundnet of claim 1, wherein each of the plurality of legs contains a first leg socket and the second leg socket having an asymmetrical cross section to fixedly attach at least one of the plurality of slotted tubing having a complimentary shape.

8. The roundnet of claim 1, wherein the plurality of slotted tubing is attached to the plurality of legs by friction.

9. The roundnet of claim 1, wherein the track of clips is substantially aligned with each end of the slot when fully inserted into the slot.

10. The roundnet of claim 1, wherein at least one of the plurality of track of clips comprises two or more sections.

11. The roundnet of claim 1, wherein at least one slot in the plurality of slotted tubing is oval.

12. The roundnet of claim 1, wherein at least one slot in the plurality of slotted tubing is polygonal.

13. The roundnet of claim 1, wherein the plurality of slotted tubing is extrusion molded plastic.

14. The roundnet of claim 1, wherein the track of clips is injection molded to yield the unitary structure.

15. The roundnet of claim 1, wherein the perimeter is substantially circular.

16. The roundnet of claim 1, wherein the perimeter is substantially polygonal.

17. The roundnet of claim 1, wherein the net elastically extends to attach to a plurality of the track of clips around the perimeter of the roundnet.

18. A roundnet game, comprising:

a plurality of legs attached to a plurality of slotted tubing forming a roundnet perimeter;

a unitary track of clips configured for insertion into a slot corresponding to at least one of the plurality of the slotted tubing, the track of clips extending an entire length of the slot;

a net, wherein the net is attachable to the unitary track of clips, and wherein the net forms a playing surface of the roundnet; and a ball for bouncing off the playing surface.

19. A component of a roundnet game comprising:

a tube with at least one slot attachable to a leg to form a roundnet perimeter; and a unitary track of clips extending an entire length of the at least one slot and configured for insertion into any at least one of a plurality of the slotted tubing.

* * * * *